US005802436A

United States Patent [19]

Lang et al.

[11] Patent Number: 5,802,436

[45] Date of Patent: *Sep. 1, 1998

[54] APPARATUS FOR REMOVAL OF BACK-PLATED DEVELOPER FROM A DEVELOPMENT DEVICE

[75] Inventors: Arthur V. Lang, Maplewood; Donald H. Larson, Stillwater, both of Minn.

[73] Assignee: Minnesota Mining and Manufacturing Company, Saint Paul, Minn.

[ * ] Notice: The term of this patent shall not extend beyond the expiration date of Pat. No. 5,576,815.

[21] Appl. No.: 919,554

[22] Filed: Aug. 28, 1997

Related U.S. Application Data

[63] Continuation of Ser. No. 811,661, Mar. 4, 1997.

[51] Int. Cl.[6] ..... G03G 15/10

[52] U.S. Cl. ..... 399/249; 399/237; 399/239; 399/348

[58] Field of Search ..... 399/237, 238, 399/239, 249, 348; 15/256.51, 256.52

[56] References Cited

U.S. PATENT DOCUMENTS

| | | | |
|---|---|---|---|
| Re. 34,437 | 11/1993 | Airyama . | |
| 3,654,659 | 4/1972 | Blumenthal | 15/306 |
| 3,710,469 | 1/1973 | Kitazawa | 29/125 |
| 3,741,643 | 6/1973 | Smith et al. . | |
| 3,750,246 | 8/1973 | Pessen | 29/130 |
| 3,815,989 | 6/1974 | Davis et al. . | |
| 3,843,407 | 10/1974 | Thorp | 134/6 |
| 3,850,099 | 11/1974 | Laben | 101/425 |
| 3,910,231 | 10/1975 | Inoue et al. | 118/637 |
| 3,940,282 | 2/1976 | Hwa | 134/6 |
| 3,955,533 | 5/1976 | Smith et al. | 118/637 |
| 4,181,094 | 1/1980 | Gardiner . | |
| 4,395,113 | 7/1983 | Buchan et al. . | |
| 4,416,201 | 11/1983 | Kessler | 101/348 |

(List continued on next page.)

FOREIGN PATENT DOCUMENTS

| | | |
|---|---|---|
| 0 575 698 | 12/1993 | European Pat. Off. . |
| 0 657 786 | 6/1995 | European Pat. Off. . |
| 1 579 405 | 11/1980 | United Kingdom . |

OTHER PUBLICATIONS

JP2196267, publication date Aug. 2, 1990, Japanese abstract.

JP4125672, publication date Apr. 27, 1992, Japanese abstract.

JP5019634, publication date Feb. 29, 1993, Japanese abstract.

JP5027653, publication date Feb. 5, 1993, Japanese abstract.

JP55106480, publication date Aug. 15, 1980, Japanese abstract.

JP55015190, publication date Feb. 2, 1980, Japanese abstract.

JP60060678, publication date Apr. 8, 1985, Japanese abstract.

JP63266475, publication date Nov. 2, 1988, Japanese abstract.

5–19634, publication date Jan. 29, 1993, Japanese abstract.

4–69680, publication date Mar. 1992, Japanese abstract.

6–95472, publication date Apr. 8, 1994, Japanese abstract.

53–22435, publication date Jan. 3, 1978, Japanese abstract.

*Primary Examiner*—Matthew S. Smith

*Attorney, Agent, or Firm*—William D. Bauer

[57] ABSTRACT

An apparatus for removing back-plated developer from a development device includes a shaft, cleaning media mounted about the outer surface of the shaft, means for loading the cleaning media against the development device, and means for rotating the shaft and the cleaning media, wherein the cleaning media removes back-plated developer from the development device. The cleaning media may include a fiber material having a plurality of flow paths. A fluid flow means can be provided to deliver a cleaning liquid to the cleaning media to flush at least a portion of the removed back-plated developer from the cleaning media.

23 Claims, 4 Drawing Sheets

U.S. PATENT DOCUMENTS 4,436,054 3/1984 Ceelen et al. .
4,483,242 11/1984 Moraw et al. .
4,627,705 12/1986 Landa et al. .
4,640,605 2/1987 Ariyama et al. .
4,669,859 6/1987 Mochizuki et al. .
4,682,881 7/1987 Komatsubara et al. .
4,728,987 3/1988 Diola et al. .
4,801,965 1/1989 Mochizuki et al. .
4,905,047 2/1990 Ariyama .
4,935,788 6/1990 Fantuzzo et al. .
4,956,211 9/1990 Saito ..... 428/36.5
4,990,962 2/1991 Kishi .
5,021,834 6/1991 Tsuruoka et al. .
5,092,235 3/1992 Rise ..... 100/168
5,122,839 6/1992 Siegel et al. .
5,155,534 10/1992 Kurotori et al. .
5,195,430 3/1993 Rise ..... 100/168
5,220,384 6/1993 Landa et al. .
5,221,944 6/1993 Yoda et al. .
5,262,259 11/1993 Chou et al. ..... 430/47
5,289,238 2/1994 Lior et al. .
5,300,990 4/1994 Thompson .
5,359,398 10/1994 Echigo et al. .
5,369,477 11/1994 Foote et al. .
5,374,980 12/1994 Kubo et al. .
5,384,225 1/1995 Kurotori et al. ..... 430/116
5,420,675 5/1995 Thompson et al. .
5,420,676 5/1995 Arcaro .
5,432,591 7/1995 Geleynse .
5,463,453 10/1995 Kurotori et al. .
5,576,815 11/1996 Teschendorf et al. .

APPARATUS FOR REMOVAL OF BACK-PLATED DEVELOPER FROM A DEVELOPMENT DEVICE

This is a continuation of application Ser. No. 08/811,661 filed Mar. 4, 1997 pending.

FIELD OF THE INVENTION

The present invention relates generally to liquid electrographic imaging technology and, more particularly, to techniques for removal of back-plated developer from a development device in a liquid electrographic imaging system.

DISCUSSION OF RELATED ART

A liquid electrographic imaging system includes an imaging substrate onto which a developer liquid is delivered to develop a latent image. A liquid electrographic imaging system may comprise as the imaging substrate a dielectric or a photoreceptor. A photoreceptor includes a photoconductive material. A latent image can be formed on a photoreceptor by selectively discharging the photoreceptor with a pattern of radiation, whereas a latent image can be formed on a dielectric by selectively discharging the dielectric with an electrostatic stylus. A liquid electrophotographic imaging system will be discussed for purposes of example.

A liquid electrophotographic imaging system generally includes a photoreceptor, an erasure station, a charging station, an exposure station, a development station, an image drying station, and a transfer station. The photoreceptor may take the form of a photoreceptor belt, a photoreceptor drum, or a photoreceptor sheet. For an imaging operation, the photoreceptor is moved past each of the stations in the liquid electrographic imaging system.

The erasure station exposes the photoreceptor to erase radiation sufficient to uniformly discharge any electrostatic charge remaining from a previous imaging operation. The charging station electrostatically charges the surface of the photoreceptor. The exposure station selectively discharges the surface of the photoreceptor to form a latent electrostatic image. A multi-color imaging system may include several exposure stations that form a plurality of latent images. Each of the latent images in a multi-color imaging system is representative of one of a plurality of color separation images for an original multi-color image to be reproduced.

As a latent image is formed, the development station applies developer liquid to the photoreceptor to develop the latent image. In a multi-color imaging system, each of a plurality of development stations applies an appropriately colored developer liquid to the photoreceptor to form an intermediate representation of the corresponding color separation image. The drying station dries the developer liquid applied by the development station or stations. The transfer station then transfers the developer liquid applied by the development stations from the photoreceptor to an output substrate, such as a sheet of paper or film, to form a visible representation of the original image.

A development station generally includes a development device such as, for example, a development roller or belt. The operation of a development roller will be described for purposes of example. The development roller is rotated by a drive mechanism and charged with a bias potential. The rotating, charged development roller delivers developer liquid to the surface of an imaging region of the photoreceptor to develop the latent image. The development roller typically is positioned a short distance from the surface of the photoreceptor, enabling a thin layer of developer liquid to be delivered across the resulting gap. In a multi-color imaging system, the development process is repeated with each of a plurality of development rollers applying differently colored developer liquids to the photoreceptor to develop different color separation images.

During operation, back-plated developer particles can accumulate on the surface of the development roller. The term "back-plated" refers to an amount of developer that develops on the development roller due to a potential difference between the surface of the photoreceptor and the surface of the development roller. The developer liquid on the rotating development roller wets the surface of the photoreceptor, creating the development nip. When the imaging region of the photoreceptor enters the development nip, the background areas of the image are at a potential slightly higher than the development roller bias and the latent image is at a potential significantly lower than the development roller bias.

The potential difference between the development roller bias and the latent image results in "forward-plating" of developer liquid to the latent image. The potential difference between the background areas and the development roller bias results in "back-plating" of developer liquid to the surface of the development roller. The back-plated developer retains a small charge that, if allowed to accumulate, will affect the development vector necessary for proper image development. The accumulation of back-plated developer can cause inconsistent transfer of developer liquid to the surface of the photoreceptor. In addition, the back-plated developer can accumulate on other components in the development station, affecting delivery of developer liquid to the development roller.

To avoid excessive accumulation of back-plated developer on the development roller, it ordinarily is desirable to provide an apparatus for removing the back-plated developer. In existing liquid electrographic systems, the developer removal apparatus generally comprises a cleaning blade or cleaning roller. A cleaning blade scrapes developer away from the surface of the development roller. A cleaning roller is rotated to remove the back-plated developer from the development roller. The removed developer is carried away by the surface of the cleaning roller.

The back-plated developer removed from the development roller can accumulate on a cleaning blade or cleaning roller. The back-plated developer has a generally sludge-like consistency and can affect the cleaning efficiency of the cleaning blade or cleaning roller. When the accumulation becomes excessive, the cleaning blade or cleaning roller can actually transfer some of the accumulated developer back to the development roller, completely undermining the effectiveness of the developer removal apparatus. Excessive accumulation of back-plated developer requires replacement or cleaning of the cleaning blade or cleaning roller by a field service technician.

To reduce the number of maintenance operations, increase the time between maintenance operations, and to generally avoid the problems associated with back-plated developer, there is a need for an improved apparatus for removing the back-plated developer from a development roller. In particular, there is a need for an apparatus capable of maintaining effective removal of back-plated developer from the development roller over an extended period of time.

SUMMARY OF THE INVENTION

The present invention is directed to an apparatus for removing back-plated developer from a development device in a liquid electrographic imaging system. The present invention also is directed to an imaging system incorporating such an apparatus for removing back-plated developer from a development device. The apparatus of the present invention is capable of providing enhanced cleaning efficiency and maintaining such enhanced cleaning efficiency for extended periods of time. In addition, the apparatus of the present invention is capable of redispersing the back-plated developer for recovery and reuse, thereby reducing developer liquid consumption.

In a first embodiment, the developer removal apparatus and imaging system of the present invention comprise a shaft having a fluid flow means for delivering a cleaning liquid to an outer surface of the shaft, cleaning media mounted about the outer surface of the shaft, the cleaning media receiving the cleaning liquid, means for loading the cleaning media against the development device, and means for rotating the shaft and cleaning media, wherein the cleaning media removes back-plated developer from the development device and the cleaning liquid flushes at least a portion of the removed back-plated developer from the cleaning media.

In a second embodiment, the developer removal apparatus and imaging system of the present invention comprise a shaft, cleaning media mounted about the outer surface of the shaft, the cleaning media including a fiber material, means for loading the cleaning media against the development device, and means for rotating the shaft and the cleaning media, wherein the cleaning media removes back-plated developer from the development device.

In a third embodiment, the developer removal apparatus and imaging system of the present invention comprise a shaft, cleaning media mounted about the outer surface of the shaft, means for delivering cleaning liquid to the cleaning media, means for loading the cleaning media against the development device, and means for rotating the shaft and cleaning media, wherein the cleaning media removes back-plated developer from the development device and the cleaning liquid flushes at least a portion of the removed back-plated developer from the cleaning media.

The advantages of the present invention will be set forth in part in the description that follows, and in part will be apparent from the description, or may be learned by practice of the present invention. The advantages of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION

Figure 1:
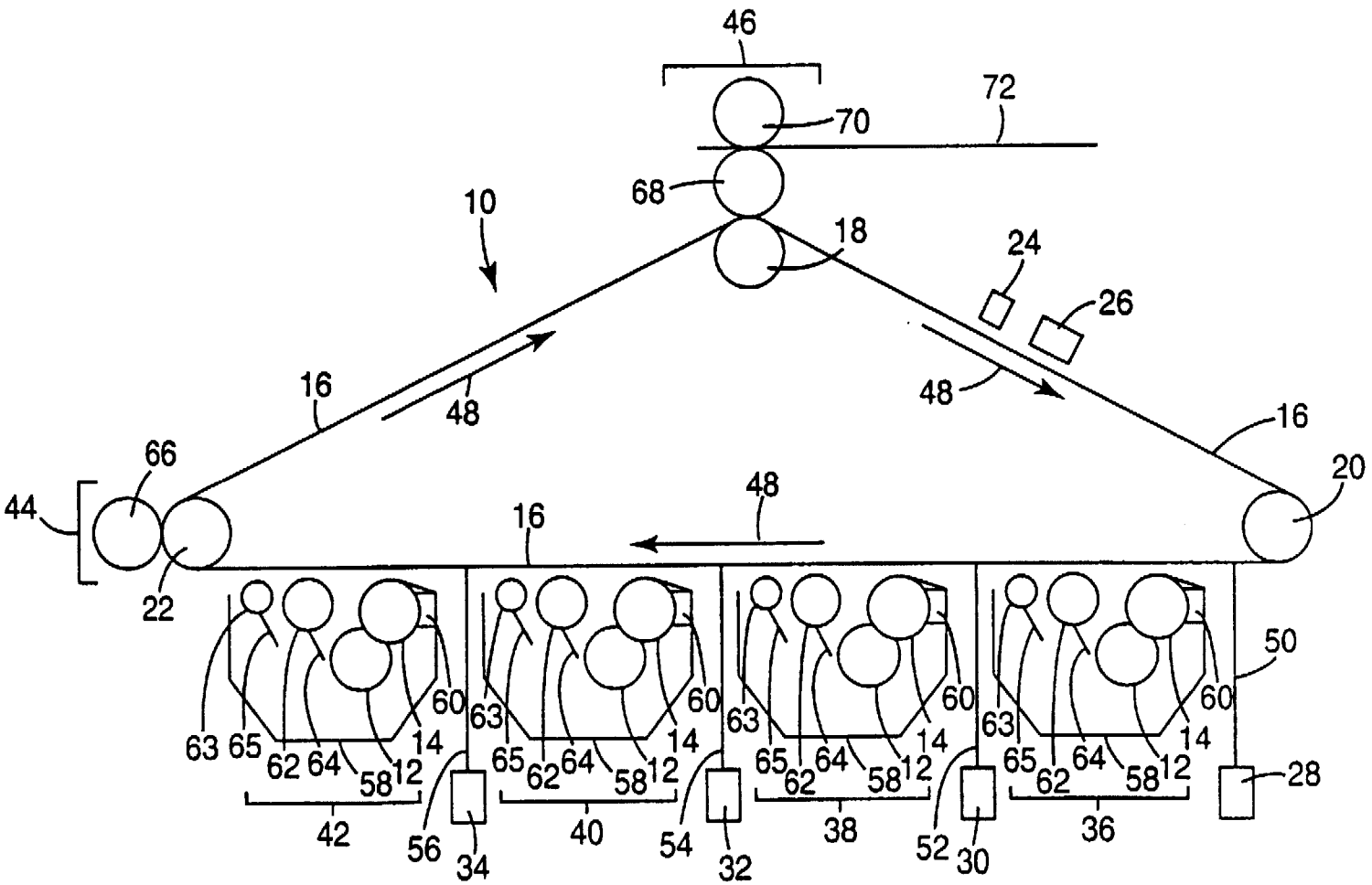
FIG. 1 is a schematic diagram of an exemplary liquid electrographic imaging system, in accordance with the present invention.

FIG. 1 is a schematic diagram of an exemplary liquid electrographic imaging system 10 incorporating an apparatus for removing back-plated developer from a development device, in accordance with the present invention. As shown in FIG. 1, the developer removal apparatus comprises a cleaning roller 12. The cleaning roller 12 will be described in detail later in this description. As further shown in FIG. 1, the development device may comprise a development roller 14. As an alternative, a development belt or other suitable development device could be employed.

The liquid electrographic system 10 of FIG. 1 is a liquid electrophotographic system 10 incorporating as the imaging substrate a photoreceptor 16. The system 10 of FIG. 1 is configured to form a multi-color image in a single pass of photoreceptor 16. The single-pass system 10 enables multi-color images to be assembled at extremely high speeds. An example of a liquid electrophotographic imaging system configured to assemble a multi-color image in a single pass of a photoreceptor is disclosed in copending and commonly assigned U.S. patent application Ser. No. 08/537,296, filed Sep. 29, 1995, entitled "METHOD AND APPARATUS FOR PRODUCING A MULTI-COLORED IMAGE IN AN ELECTROPHOTOGRAPHIC SYSTEM". The entire content of the above-referenced patent application is incorporated herein by reference.

Although imaging system 10 is shown as a multi-color, single-pass system in FIG. 1, the apparatus of the present invention can be readily applied to remove back-plated developer from development devices in both single-color liquid electrographic imaging systems and multi-color, multi-pass liquid electrographic imaging systems. In addition, the apparatus of the present invention can be readily applied to remove back-plated developer in systems in which the photoreceptor is configured as a photoreceptor belt, a photoreceptor drum, or a photoreceptor sheet. The apparatus and method of the present invention similarly could be applied to single-pass or multi-pass electrographic systems incorporating dielectric belts, drums, or sheets. Therefore, incorporation of the apparatus and method of the present invention in the particular multi-color, single-pass imaging system 10 of FIG. 1 should be considered exemplary only.

As shown in FIG. 1, imaging system 10 includes photoreceptor 16 in the form of a continuous photoreceptor belt mounted about first, second, and third belt rollers 18, 20, 22, an erasure station 24, a charging station 26, a plurality of exposure stations 28, 30, 32, 34, a plurality of development stations 36, 38, 40, 42, a drying station 44, and a transfer station 46. In operation of system 10, photoreceptor 16 is moved to travel in a first direction indicated by arrows 48. The photoreceptor 16 can be moved, for example, by activating a motor coupled to a rotor shaft associated with one of belt rollers 18, 20, 22. As photoreceptor 16 moves in first direction 48, erasure station 24 exposes the photoreceptor to erase radiation to uniformly discharge any electrostatic charge remaining from a previous imaging operation. The charging station 26 then charges the surface of photoreceptor 16 to a predetermined level.

The exposure stations 28, 30, 32, 34 emit beams 50, 52, 54, 56 of radiation that selectively discharge an imaging region of the charged photoreceptor 16 in an imagewise pattern to form a latent electrostatic image. Each of exposure stations 28, 30, 32, 34 may comprise, for example, a scanning laser module. For multi-color imaging, each of exposure stations 28, 30, 32, 34 forms a latent image representative of one of a plurality of color separation images of an original image to be reproduced. The combination of the color separation images produces an overall multi-color representation of the original image. The exposure stations 28, 30, 32, 34 emit radiation beams 50, 52, 54, 56, respectively, to form latent images in the same imaging region of photoreceptor 16. Thus, each of exposure stations 28, 30, 32, 34 forms a latent image on photoreceptor 16 as the imaging region passes the respective exposure station.

As further shown in FIG. 1, each of development stations 36, 38, 40, 42 may include a developer liquid recovery reservoir 58, development roller 14, a plenum 60 for delivering developer liquid to the development roller, a first squeegee roller 62 for removing excess "drip line" developer liquid from photoreceptor 16, a blade 64 for removing developer liquid from the first squeegee roller, a second squeegee roller 63 for removing excess "wrap-around" developer liquid from photoreceptor 16, a blade 65 for removing developer liquid from the second squeegee roller, and cleaning roller 12 for removing back-plated developer from the development roller, in accordance with the present invention. An example of a suitable development station is disclosed in U.S. Pat. No. 5,576,815 to Teschendorf et al., entitled "DEVELOPMENT APPARATUS FOR A LIQUID ELECTROPHOTO-GRAPHIC IMAGING SYSTEM." The entire content of the above-referenced patent application is incorporated herein by reference.

The development roller 14 is in fluid communication, via plenum 60, with a source of one of a plurality of differently colored developer liquids corresponding to the particular color separation to be developed. The developer liquid can be pumped from the source to plenum 60 for application to the surface of development roller 14. Alternatively, the surface of development roller 14 could be placed in contact with the source of developer liquid, or with another roller delivering developer liquid, eliminating the need for a pump and plenum 60. The differently colored developer liquids may correspond, for example, to cyan, magenta, yellow, and black color separations.

In this description, the term "developer liquid" generally refers to the liquid applied to an imaging substrate such as photoreceptor 16 to develop a latent image. The "developer liquid" may comprise both toner particles and a carrier liquid in which the toner particles are dispersed. A suitable carrier liquid may comprise, for example, hydrocarbon solvents such as NORPAR or ISOPAR solvents commercially available from Exxon. Examples of suitable developer liquids are disclosed in copending and commonly assigned U.S. patent application Ser. No. 08/536,856, filed Sep. 29, 1995, entitled "LIQUID INK USING A GEL ORGANOSOL." The entire content of the above-referenced patent application is incorporated herein by reference.

Exemplary implementations of a squeegee apparatus are disclosed in copending and commonly assigned U.S. patent application Ser. No. 08/537,128, filed Sep. 29, 1995, entitled "SQUEEGEE APPARATUS AND METHOD FOR REMOVING DEVELOPER LIQUID FROM AN IMAGING SUBSTRATE AND FABRICATION METHOD," copending and commonly assigned U.S. patent application Ser. No. 08/536,136, filed Sep. 29, 1995, entitled "APPARATUS AND METHOD FOR REMOVING DEVELOPER LIQUID FROM AN IMAGING SUBSTRATE," and copending and commonly assigned U.S. patent application Ser. No. 08/536,521, filed Sep. 29, 1995, entitled "APPARATUS AND METHOD FOR REMOVING DEVELOPER LIQUID FROM AN IMAGING SUBSTRATE." The content of each of the above-referenced patent applications is incorporated herein by reference.

The development roller 14 can be made, for example, from stainless steel. Each of development stations 36, 38, 40, 42 may include means for engaging development roller 14 in proximity with photoreceptor 16 to develop the appropriate latent image in an imaging region of the photoreceptor. A suitable engaging means may comprise, for example, any of a variety of camming or gear-driven mechanisms configured to move one or both of development roller 14 and photoreceptor 16 relative to one another. During engagement, development roller 14 is positioned a short distance from the surface of photoreceptor 16, forming a gap. In addition, development roller 4 is moved to travel in first direction 48 by, for example, activating a motor coupled to a rotor shaft associated with the development roller. The development roller 14 supplies a thin, uniform layer of developer liquid across the gap to photoreceptor 16.

To carry out the application of developer liquid, each of development stations 36, 38, 40, 42 further includes an electrical bias means (not shown) that creates an electric field between development roller 14 and photoreceptor 16. The electric field develops the latent image previously formed by the respective exposure station 28, 30, 32, 34 with the developer liquid applied by development roller 14. The electrical bias means may comprise a charging circuit that applies to the surface of development roller 14 a charge that induces the electric field. The development roller 14 applies developer liquid to photoreceptor 16 only long enough to develop an imaging region of the photoreceptor. Upon movement of a nonimaging region of photoreceptor 16 past development roller 14, the application of developer liquid by the development roller is terminated.

The movement of photoreceptor 16 takes the latent images in the imaging region past each of development stations 36, 38, 40, 42 for development with the differently colored developer liquids applied by development rollers 14. After development stations 36, 38, 40, 42 have developed each of the latent images formed by exposure stations 28, 30, 32, 34, the imaging region of the moving photoreceptor 16 encounters drying station 44. The drying station includes a heated roller 66 that forms a nip with belt roller 22. The heated roller 66 applies heat to photoreceptor 16 to dry the developer liquid applied by development stations 36, 38, 40, 42. An example of a suitable drying station is disclosed in copending and commonly assigned U.S. patent application Ser. No. 08/536,080, filed Sep. 29, 1995, entitled "DRYING METHOD AND APPARATUS FOR ELECTROPHOTOGRAPHY USING LIQUID TONERS."

The imaging region of photoreceptor 16 next arrives at transfer station 46. The transfer station 46 includes an intermediate transfer roller 68 that forms a nip with photoreceptor 16 over belt roller 18 and a heated pressure roller 70 that forms a nip with the intermediate transfer roller. The developer liquid on photoreceptor 16 transfers from the photoreceptor surface to intermediate transfer roller 68 by selective adhesion. The heated pressure/or roller 70 serves to transfer the image on intermediate transfer roller 68 to an output substrate 72 by application of pressure and heat to the output substrate. The output substrate 72 may comprise, for example, paper or film. In this manner, transfer station 46 forms a visible representation of the original multi-color image on output substrate 72. An example of a suitable transfer station is disclosed in copending and commonly assigned U.S. patent application Ser. No. 08/536,687 filed Sep. 29, 1995, entitled "METHOD AND APPARATUS HAVING IMPROVED IMAGE TRANSFER CHARACTERISTICS FOR PRODUCING AN IMAGE ON PLAIN PAPER."

The operation of imaging system 10, as described above, generally is effective in producing a visible representation of an original multi-color image. However, the quality of the image remains a constant concern. The quality of the image can be degraded, in particular, by the accumulation of back-plated developer on the surface of development roller 14. The accumulation of developer can alter the development characteristics of development roller 14, resulting in inconsistent development of developer liquid on the surface of photoreceptor 16. Accordingly, it is desirable to provide an apparatus for removing the back-plated developer from development roller 14.

Figure 2:
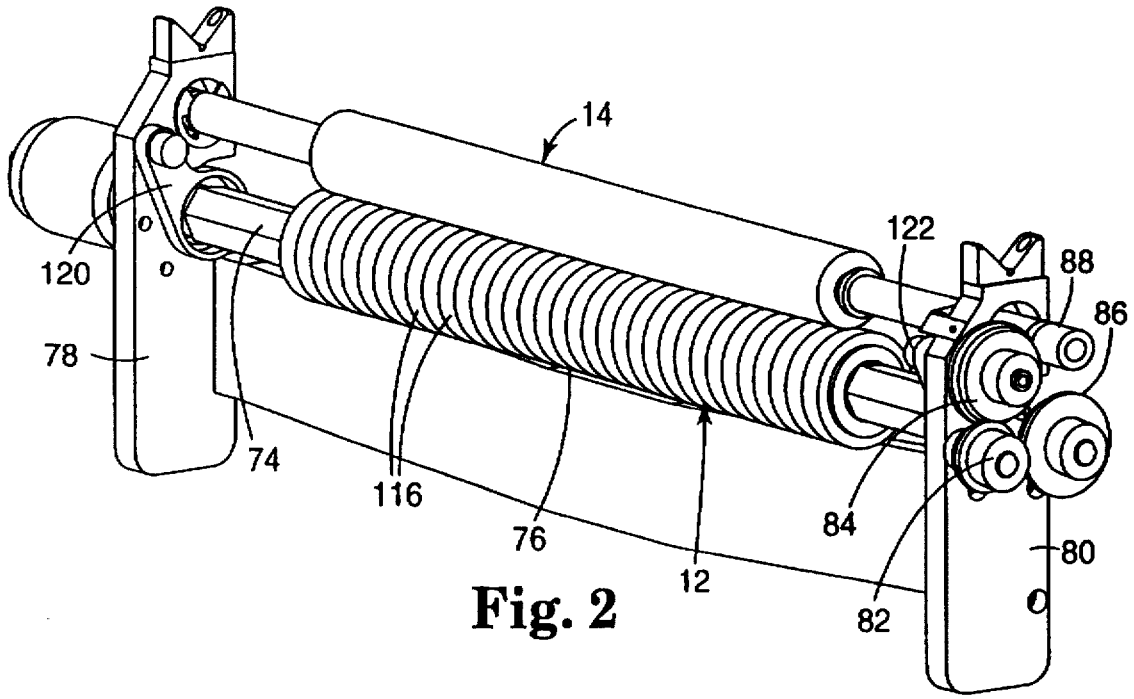
FIG. 2 is a perspective view of an apparatus for removing back-plated developer from a development device, in accordance with the present invention.

FIGS. 2–5 together illustrate an embodiment of an apparatus for removing back-plated developer from development roller 14, in accordance with the present invention. FIG. 2 is a perspective view of a back-plated developer removal apparatus, in accordance with the present invention. The apparatus includes a shaft 74 and cleaning media 76 mounted about an outer surface of the shaft. The shaft 74 and cleaning media 76 together form a cleaning roller 12. The shaft 74 includes a first end rotatably mounted in a first bearing mount 120 in a first bracket 78 and a second end rotatably mounted in a second bearing mount 122 in a second bracket 80. The development roller 14 similarly includes a shaft having a first end rotatably mounted in first bracket 78 and a second end rotatably mounted in second bracket 80. The first and second brackets 78, 80 can be mounted within a development station 36, 38, 40, 42 of liquid electrophotographic imaging system 10 of FIG. 1.

The cleaning roller 12 and development roller 14 are mounted adjacent one another such that cleaning media 76 is loaded against the outer surface of the development roller. The cleaning roller 12 can be loaded against development roller 14 with, for example, a spring mounting mechanism. Alternatively, cleaning roller 12 could be rigidly mounted to bear against development roller 14. A motor can be provided to simultaneously drive shaft 74 and the shaft of development roller 14 via gears 82, 84, 86, 88. For example, a motor can be coupled to a shaft on which gear 82 is mounted. The gear 82 can transmit rotational force from the motor to gears 84, 86, 88. The cleaning roller 12 and development roller 14 preferably are coupled to gears 82, 84, 86, 88 such that the cleaning roller is driven in a direction opposite to the development roller. In this manner, a difference in surface velocity between development roller 14 and cleaning roller 12 can be readily achieved. The cleaning roller 12 could be driven in the same direction as development roller 14, however, if the cleaning roller was geared at a higher or lower velocity.

Figure 3:
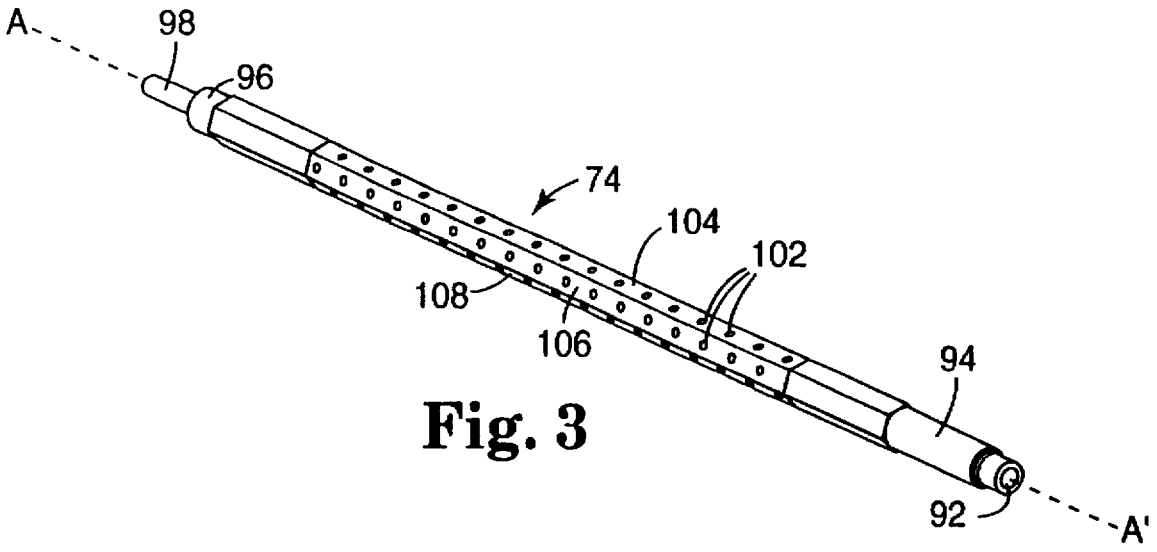
FIG. 3 is a perspective view of a shaft forming part of the apparatus shown in FIG. 2.
Figure 4A:
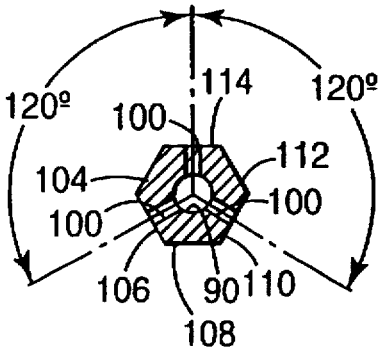
FIGS. 4A is a cross-sectional side view of the shaft shown in FIG. 3 taken along a first plane perpendicular to longitudinal axis A—A'.
Figure 4B:
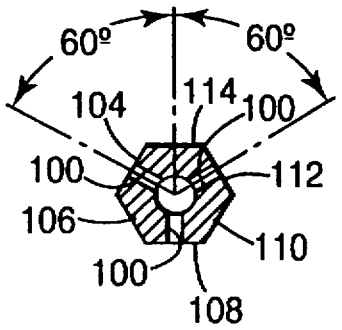
FIG. 4B is a cross-sectional side view of the shaft shown in FIG. 3 taken along a second plane perpendicular to longitudinal axis A-A'.

FIG. 3 is a perspective view of shaft 74, in accordance with the present invention, without cleaning media 76. FIGS. 4A and 4B are cross-sectional views taken at different planes of shaft 74 perpendicular to longitudinal axis A-A'. As shown in FIGS. 4A and 4B, shaft 74 includes a central fluid flow channel 90 extending along longitudinal axis A-A' of the shaft. FIG. 3 shows a bore 92 at first end 94 of shaft 74 leading to central fluid flow channel 90. The first end 94 of shaft 74 can be mounted in bearing mount 120 in first bracket 78. With further reference to FIG. 3, second end 96 of shaft 74 defines a pin 98 that can be mounted in bearing mount 122 in second bracket 80 and coupled to gear 86. As shown in FIGS. 4A and 4B, shaft 74 also includes a plurality of radial fluid flow channels 100 extending radially outward from the central fluid flow channel to an outer surface of the shaft. As shown in FIG. 3, radial fluid flow channels 100 lead to apertures 102 formed in the outer surface of shaft 74.

The shaft 74, central fluid flow channel 90, radial fluid flow channels 100, and apertures 102 can be formed, for example, from machined metal or molded plastic. The shaft 74 can have a non-circular cross section, if desired. As shown in FIGS. 3, 4A, and 4B, for example, shaft 74 may have a hexagonal cross section. The hexagonal cross section produces an outer surface of shaft 74 having flat surfaces 104, 106, 108, 110, 112, 114. Each of apertures 102 is formed in one of flat surfaces 104, 106, 108, 110, 112, 114. The radial fluid flow channels 100 can be distributed such that three radial fluid flow channels extend from a common portion of central fluid flow channel 90 at each of a plurality of positions along the length of shaft 74. The radial fluid flow channels 100 can terminate in apertures 102 formed in alternating flat surfaces 104, 106, 108, 110, 112, 114. For example, FIG. 4A shows one position along the length of shaft 74 at which radial fluid flow channels 100 lead to apertures 102 formed in alternating flat surfaces 104, 108, 112. At another position along the length of shaft 74, shown in FIG. 4B, radial fluid flow channels 100 lead to apertures 102 formed in alternating flat surfaces 106, 110, 114.

The central fluid flow channel 90 receives a cleaning liquid via a rotary union assembly mounted about first end 94 of shaft 74, as will be described. The central fluid flow channel 90 delivers the cleaning liquid to radial fluid flow channels 100. The radial fluid flow channels 100 deliver the cleaning liquid to the outer surface of shaft 74 via apertures 102. The cleaning media 76 receives the cleaning liquid from radial fluid flow channels 100 and apertures 102. The cleaning media 76 is loaded against development roller 14 to remove back-plated developer from the development roller. The cleaning media 76 preferably comprises a resiliently compliant material. The resilient compliance enables cleaning media 76 to deflect and recover upon contact with development roller 14, producing a shear action that serves to effectively remove back-plated developer from the development roller. In particular, the shear action breaks up the back-plated developer "sludge" for redispersion into the developer liquid supply. The term "redispersion" refers to the operation of breaking up the back-plated developer sludge into smaller developer particles having substantially the same size as original developer particles in the developer liquid, and reintroducing the smaller developer particles into the carrier liquid. Redispersion enables recovery and reuse of the back-plated developer, thereby reducing developer liquid consumption. The resiliently compliant material of cleaning media 76 preferably is sufficiently porous to include a plurality of flow paths. The porosity enables cleaning media 76 to receive and transmit the cleaning liquid delivered by the radial fluid flow channels 100 of shaft 74. In particular, as cleaning media 76 removes developer from development roller 14, the cleaning liquid received from radial fluid flow channels 100 flushes the removed developer away via the flow paths in the cleaning media. In addition to being resiliently compliant and porous, the material ordinarily should be electrically insulative so as to avoid altering the charge on development roller 14, and chemically inert to the developer liquid used in imaging system 10.

As shown in FIG. 2, cleaning media 76 can be realized by a plurality of rings 116 of the resiliently compliant, porous material. The rings 116 are mounted adjacent one another along the length of shaft 74. The rings 116 can be compressed against one another such that substantially no gap exists between adjacent rings. In this manner, rings 116 effectively operate as a continuous cleaning media. The rings 116 can be made, for example, by punching circular discs from a sheet of the resiliently compliant, porous material, and then punching mounting apertures in the discs. The resulting rings 116 can be stacked along the length of shaft 74 such that the shaft extends through the mounting apertures of the rings. The hexagonal cross-section of shaft 74 helps to prevent free rotation of rings 116 about the shaft. As an alternative, cleaning media 76 can be realized by mounting a continuous sleeve of the resiliently compliant, porous material about shaft 74. As a further alternative, a continuous length of the resiliently compliant, porous material could be wrapped about the outer surface of shaft 74 in a tight helical pattern to form a substantially continuous cleaning media 76.

The resiliently compliant, porous material forming cleaning media 76 can be realized, for example, by an open-cell foam or a woven fabric material that enables the flow of cleaning liquid through holes in the material to flush away developer removed from development roller 14. The resiliently compliant, porous material forming cleaning media 76 preferably is realized, however, by a non-woven, air laid fiber material or by a non-woven blown micro fiber material. An example of a non-woven, air laid fiber material suitable for fabrication of cleaning media 76 is SCOTCHBRITE™ T-TALC material, commercially available from Minnesota Mining and Manufacturing Company (3M) of St. Paul, Minn. This air laid fiber material provides resilient compliance sufficient to deflect and recover upon contact with development roller 14. This air laid fiber material also is sufficiently porous to allow flow of cleaning liquid from apertures 102 to flush away back-plated developer removed from development roller 14.

The fiber material can provide a coarse cleaning media 76 that aids in scrubbing developer from development roller 14. In particular, if the fiber material is cut, such as by punching from a larger sheet, fiber bristles tend to be exposed at cleaning media 76. The fiber bristles can enhance the scrubbing action of cleaning media 76. The fiber material can be impregnated with abrasive material, if desired, for enhanced scrubbing. The use of an abrasive material ordinarily will be undesirable, however, in view of potential damage to development roller 14. Thus, the fiber material preferably is substantially non-abrasive. The rings 116 can be subjected to a surface grinding operation, if desired, to produce a uniform dimension about shaft 74 that approximates a right circular cylinder. The uniform dimension enhances uniformity of contact of rings 116 with development roller 14.

The cleaning liquid flowing through central fluid flow channel 90, radial fluid flow channels 100, and cleaning media 76 loosens developer removed from development roller 14 and flushes the developer from the cleaning media. The cleaning liquid can be realized by a solvent such as, for example, NORPAR or ISOPAR solvent, commercially available from Exxon. The cleaning liquid preferably is realized, however, by the developer liquid used by imaging system 10. Specifically, the cleaning liquid used by imaging system 10 may comprise developer particles dispersed in a carrier liquid such as NORPAR or ISOPAR solvent. The developer liquid can be pumped through central fluid flow channel 90, radial fluid flow channels 100, and cleaning media 76, and used to dislodge back-plated developer from development roller 14. In a multi-color system, the developer liquid should be of the same color as the back-plated developer to avoid cross-contamination of colors. If developer recovery is not a concern, a solvent, by itself, could be used. The back-plated developer removed from development roller 14 is flushed into developer liquid recovery reservoir 58, shown in FIG. 1, by the developer liquid and reconstituted into the developer liquid supply for imaging system 10. The developer liquid tends to act like a solvent to the sludge-like back-plated developer particles. The flushing action of the developer liquid keeps cleaning media 76 substantially free of back-plated developer removed from development roller 14, thereby maintaining the cleaning efficiency of cleaning roller 12 for an extended period of time.

Figure 5:
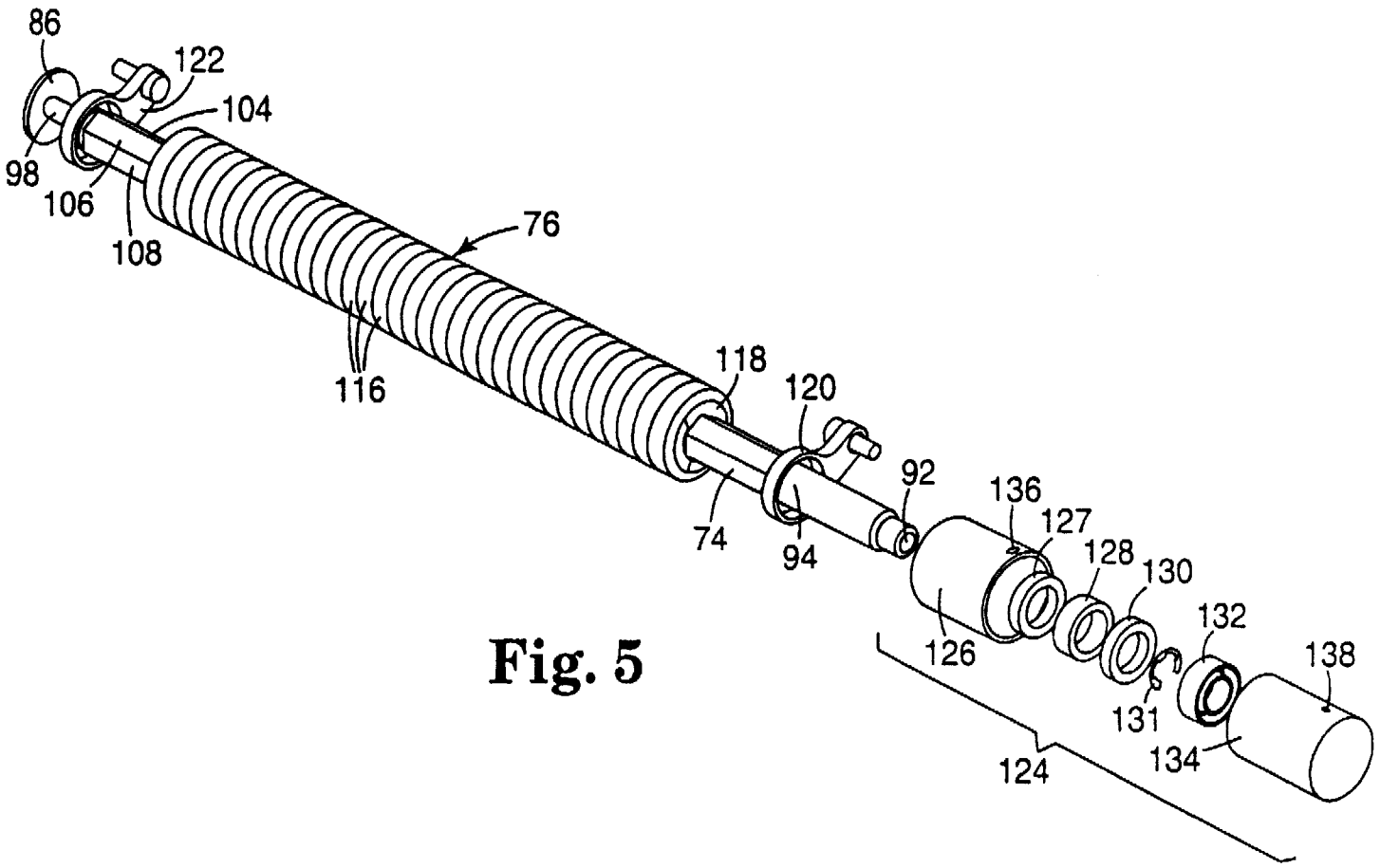
FIG. 5 is an exploded perspective view of part of the apparatus of FIG. 2, in accordance with the present invention.

FIG. 5 is an exploded perspective view of part of the apparatus of FIG. 2, in accordance with the present invention. FIG. 5 illustrates exemplary structure for mounting rings 116 on shaft 74 to form cleaning media 76, exemplary structure for mounting shaft 74 within first bearing mount 120 in first bracket 78 and second bearing mount 122 in second bracket 80, and exemplary structure for transmitting cleaning liquid to central fluid flow channel 90 and radial fluid flow channels 100. The structure for mounting rings 116 on shaft 74 may include, for example, a pair of clips that compressively hold the rings together. FIG. 5 shows one clip 118. As shown in FIG. 5, first and second bearing mounts 120, 122 can be mounted to first and second brackets 78, 80. The first bearing mount 120 supports first end 94 of shaft 74, whereas second bearing mount 122 supports second end 96 of the shaft. The pin 98 formed at second end 96 of shaft 74 can be coupled to gear 86 to enable rotation of the shaft for cleaning operations.

The structure for transmitting cleaning liquid to central fluid flow channel 90, radial fluid flow channels 100, and ultimately cleaning media 76 may include a rotary union assembly 124. As shown in FIG. 5, rotary union assembly 124 may include a retainer housing 126, ring spacer 128, ball bearings 127 and 130, a clip 131, a seal 132, and rotational feed housing 134. The retainer housing 126 and rotational feed housing 134 are coupled to one another via a pair of screw holes 136, 138 and a screw, and together house ring spacer 128, ball bearings 127 and 130, clip 131, and seal 132. The first end 94 of shaft 74 extends through ring spacer 128, ball bearings 127 and 130, clip 131, and seal 132 such that bore 92 is accessible by an interior cavity of rotational feed housing 134. The shaft 74 is free to rotate within ring spacer 128, ball bearings 127 and 130, clip 131 and seal 132, in response to rotational force from gear 86. The retainer housing 126 and rotational feed housing 134 remain fixed.

An aperture (not shown) in rotational feed housing 134 is fitted with a fluid feed line. The fluid feed line is used to feed cleaning liquid, under pressure provided by an external pump, into the cavity of rotational feed housing 134. The cleaning liquid is thereby transmitted into bore 92, along central fluid flow channel 90, and to radial fluid flow channels 100. In this manner, the cleaning liquid is made to flow through the porous material of cleaning media 76, flushing away back-plated developer removed from development roller. The pressure of the flow can be adjusted via the pump to achieve a desired flushing action within cleaning media 76. The flushing action dislodges the developer removed from development roller 14 for reconstitution into the developer liquid supply of imaging system 10.

The following non-limiting example is provided to further illustrate the structure and functionality of an apparatus for removing back-plated developer from a development roller, in accordance with the present invention.

EXAMPLE

A piece of brass was machined to produce a shaft conforming substantially to shaft 74 shown in FIG. 3. A portion of the shaft having a hexagonal cross-section had a length of approximately 32.0 centimeters. The shaft had a dimension between opposing surfaces of the hexagon of approximately 1.27 centimeters. A longitudinal bore was formed in the shaft to form a central fluid flow channel. The central fluid flow channel had a diameter of approximately 0.62 centimeters and a length of approximately 30.8 centimeters. One-hundred and two radial flow channels were formed in the hexagonal portion of the shaft. Each of the radial fluid flow channels extended radially outward from the central fluid flow channel to an aperture in an outer surface of the shaft. Each of the radial fluid flow channels and the apertures had a diameter of approximately 0.26 centimeters. Each of the radial fluid flow channels had a length of approximately 0.32 centimeters. The radial fluid flow channels were spaced along the length of the hexagonal portion of the shaft. The radial fluid flow channels were divided into sets of three extending from a common section of the central fluid flow channel. Each set of three radial fluid flow channels was spaced from adjacent sets by approximately 0.64 centimeters along the length of the shaft. The radial fluid flow channels in each set were formed approximately 120 degrees from one another such that the channels terminated at apertures formed in alternating flat surfaces of the hexagonal shaft.

Sixty rings of SCOTCHBRITE™ T-TALC air laid fiber material were mounted about the hexagonal portion of the shaft. Each ring had a compressed thickness of approximately 0.36 centimeters extending along the length of the shaft when compressed with other rings on the shaft, and an uncompressed thickness of approximately 0.75 centimeters. Each ring had an overall diameter of approximately 2.54 centimeters. With a mounting aperture having a diameter of approximately 1.27 centimeters, each of the rings had a radial thickness extending outward from the shaft of approximately 0.64 centimeters. The rings were formed by punching discs out of a sheet of SCOTCHBRITE™ T-TALC air laid fiber material, and punching mounting apertures in the discs. Clips were used to hold the discs on the shaft. The shaft, with the fiber rings, was loaded against a development roller with a loading force of approximately 0.68 kilograms at each end.

A rotary union substantially as described with respect to FIGS. 5 and 6 was coupled to an end of the shaft having an open bore leading to the central fluid flow channel. A source of developer liquid was coupled to the rotary union and forced into the rotary union and the central fluid flow channel with a pump. Another end of the shaft was coupled to a gear. The gear was driven by a motor to rotate the shaft at a rate of approximately 57 rpm. The pump was adjusted to force developer liquid into the central fluid flow channel at a flow rate of approximately 0.5 liters/minute. As the shaft was rotated, the fiber rings removed back-plated developer from the development roller. At the same time, the developer liquid forced into the central fluid flow channel was forced out of the radial fluid flow channels and through the fiber rings, flushing away the removed back-plated developer.

Having described the exemplary embodiments of the apparatus and method of the present invention, additional advantages and modifications will readily occur to those skilled in the art from consideration of the specification and practice of the invention disclosed herein. For example, instead of feeding fluid through shaft 74, the apparatus could be modified to flush developer liquid from cleaning media 76 by alternative fluid flow means such as immersion of cleaning roller 12 in cleaning liquid or by curtain feeding cleaning liquid over the cleaning roller. In addition, it is conceivable that effective cleaning could be achieved for a period of time without providing fluid flow to flush developer liquid from cleaning media 76. Therefore, the specification and examples should be considered exemplary only, with the true scope and spirit of the invention being indicated by the following claims.

What is claimed is:

1. An apparatus for removing back-plated developer from a development device in a liquid electrographic imaging system, the apparatus comprising:

a shaft having a fluid flow means for delivering a cleaning liquid to an outer surface of the shaft;

cleaning media mounted about the outer surface of the shaft, the cleaning media receiving the cleaning liquid;

means for loading the cleaning media against the development device; and means for rotating the shaft and cleaning media, wherein the cleaning media removes back-plated developer from the development device and the cleaning liquid flushes at least a portion of the removed back-plated developer from the cleaning media.

2. The apparatus of claim 1, wherein the fluid flow means comprises a central fluid flow channel extending along a longitudinal axis of the shaft and a plurality of radial fluid flow channels extending radially outward from the central fluid flow channel to the outer surface of the shaft, wherein the central fluid flow channel delivers the cleaning liquid to the radial fluid flow channels and the radial fluid flow channels deliver the cleaning liquid to the outer surface of the shaft.

3. The apparatus of claim 1, wherein the cleaning media includes a plurality of flow paths, the cleaning liquid being transmitted through the flow paths to flush the removed back-plated developer from the cleaning media.

4. The apparatus of claim 3, wherein the cleaning media comprises a blown micro fiber material.

5. The apparatus of claim 3, wherein the cleaning media comprises a non-woven fiber material.

6. The apparatus of claim 3, wherein the cleaning media comprises a plurality of rings formed from the fiber material, the rings being mounted adjacent to one another about the outer surface of the shaft.

7. The apparatus of claim 3, wherein the cleaning media comprises a continuous length of the fiber material, the continuous length being wrapped about the outer surface of the shaft in a helical pattern.

8. The apparatus of claim 3, wherein the cleaning media comprises a continuous sleeve of the fiber material, the continuous sleeve being mounted about the outer surface of the shaft.

9. The apparatus of claim 3, wherein the fiber material is cut to expose a plurality of fiber bristles.

10. The apparatus of claim 1, wherein the cleaning liquid comprises developer liquid.

11. The apparatus of claim 1, wherein the development device comprises a development roller.

12. A liquid electrographic imaging system comprising:

an imaging substrate;

means for forming a latent electrostatic image on an imaging region of the imaging substrate;

a development device, the development device transferring developer liquid to the imaging region of the imaging substrate, thereby developing the latent electrostatic image;

a shaft having a fluid flow means for delivering a cleaning liquid to an outer surface of the shaft;

cleaning media mounted about the outer surface of the shaft, the cleaning media receiving the cleaning liquid;

means for loading the cleaning media against the development device;

means for rotating the shaft and cleaning media, wherein the cleaning media removes back-plated developer from the development device and the cleaning liquid flushes at least a portion of the removed back-plated developer from the cleaning media; and a transfer station for transferring the developer liquid on the imaging region of the imaging substrate to an output substrate, thereby forming a visible representation of an image.

13. The imaging system of claim 12, wherein the fluid flow means comprises a central fluid flow channel extending along a longitudinal axis of the shaft and a plurality of radial fluid flow channels extending radially outward from the central fluid flow channel to the outer surface of the shaft, wherein the central fluid flow channel delivers the cleaning liquid to the radial fluid flow channels and the radial fluid flow channels deliver the cleaning liquid to the outer surface of the shaft.

14. The imaging system of claim 12, wherein the cleaning media includes a plurality of flow paths, the cleaning liquid being transmitted through the flow paths to flush the removed back-plated developer from the cleaning media.

15. The imaging system of claim 14, wherein the cleaning media comprises a blown micro fiber material.

16. The imaging system of claim 14, wherein the cleaning media comprises a non-woven fiber material.

17. The imaging system of claim 14, wherein the cleaning media comprises a plurality of rings formed from the fiber material, the rings being mounted adjacent to one another about the outer surface of the shaft.

18. The imaging system of claim 14, wherein the cleaning media comprises a continuous length of the fiber material, the continuous length being wrapped about the outer surface of the shaft in a helical pattern.

19. The imaging system of claim 14, wherein the cleaning media comprises a continuous sleeve of the fiber material, the continuous sleeve being mounted about the outer surface of the shaft.

20. The imaging system of claim 14, wherein the fiber material is cut to expose a plurality of fiber bristles.

21. The imaging system of claim 12, wherein the cleaning liquid comprises a portion of the developer liquid.

22. The imaging system of claim 12, wherein the development device comprises a development roller.

23. An apparatus for removing back-plated developer from a development device in a liquid electrographic imaging system, the apparatus comprising:

a shaft;

cleaning media mounted about the outer surface of the shaft;

means for delivering cleaning liquid to the cleaning media;

means for loading the cleaning media against the development device; and means for rotating the shaft and cleaning media, wherein the cleaning media removes back-plated developer from the development device and the cleaning liquid flushes at least a portion of the removed back-plated developer from the cleaning media.

* * * * *